US007286790B2

(12) United States Patent
Preston et al.

(10) Patent No.: US 7,286,790 B2
(45) Date of Patent: Oct. 23, 2007

(54) TRICKLE COLLECTION SYSTEM AND METHOD, AND ELECTROPHOTOGRAPHIC SYSTEM USING THE SAME

(75) Inventors: Todd K. Preston, Rochester, NY (US); Richard A. Kalb, Rochester, NY (US); James J. Spence, Honeoye Falls, NY (US); Robert A. Pictor, Webster, NY (US)

(73) Assignee: Xerox Corporation, Stamford, CT (US)

( * ) Notice: Subject to any disclaimer, the term of this patent is extended or adjusted under 35 U.S.C. 154(b) by 176 days.

(21) Appl. No.: 11/224,019

(22) Filed: Sep. 13, 2005

(65) Prior Publication Data

US 2007/0059044 A1 Mar. 15, 2007

(51) Int. Cl.
*G03G 15/08* (2006.01)
*G03G 15/04* (2006.01)

(52) U.S. Cl. ..... 399/257; 399/119; 399/120

(58) Field of Classification Search ..... 399/111, 399/112, 113, 119, 120, 257
See application file for complete search history.

(56) References Cited

U.S. PATENT DOCUMENTS 6,353,722 B1 * 3/2002 Klimley et al. ..... 399/257
7,155,148 B2 * 12/2006 Nishimura et al. ..... 399/257

* cited by examiner

*Primary Examiner*—Hoang Ngo
(74) *Attorney, Agent, or Firm*—Oliff & Berridge, PLC

(57) ABSTRACT

A trickle collection system including a trickle port formed in a developer housing and communicating with the interior of the developer housing, and a trickle port housing communicating the trickle port with an external vacuum collection source. The trickle port may include an aperture having a variable cross-section, for controlling an amount of flow of trickle through the trickle port. The trickle collection system also may include an air infusion port communicating the interior of the trickle port housing with external air and providing infusion of an amount of external air into the trickle port housing sufficient to facilitate flow of trickle from the trickle port to the external vacuum collection system. An aperture of the air infusion port may be variable, such that the amount of air infusion may be varied in accordance with internal and/or external conditions. The trickle collection system further may include a toner emission manifold disposed below the developer housing, where the toner emission manifold includes a toner collection port that collects toner adjacent a developer transfer region of the developer housing, and where the trickle port housing communicates with the toner emission manifold at a location remote from the developer transfer region. The trickle collection system may include the vacuum collection system and/or the toner emission manifold. An electrophotographic system of the present disclosure includes a developer housing, a vacuum collection source, and a trickle collection system including a trickle port and a trickle port housing, where the trickle port communicates the interior of the developer housing with the trickle port housing, and the trickle port housing communicates the trickle port with the vacuum collection source.

19 Claims, 4 Drawing Sheets

TRICKLE COLLECTION SYSTEM AND METHOD, AND ELECTROPHOTOGRAPHIC SYSTEM USING THE SAME

BACKGROUND

The present disclosure relates generally to an electrophotographic system, such as a xerographic system, and more particularly to an improved trickle collection system and method for an electrophotographic system including a trickle port and trickle port housing communicating the interior of a developer housing with a vacuum collection source.

Electrophotographic methods and apparatus are well known. FIG. 1 schematically illustrates an electrophotographic apparatus. As shown therein, an electrophotographic apparatus generally includes an imaging portion for generating an electrostatic latent image on an image bearing member, such as a recording sheet or media, a developing portion for applying toner to the latent image to develop the image on the image bearing member, and a fixing portion for fixing the developed toner image on the image bearing member.

Image developing systems including developer cartridges and developer are well known. A known developer includes a combination of magnetizable carrier particles, such as steel beads, and non-magnetic toner particles. The carrier particles are transported by mechanical means and magnetic fields that move within the developer cartridge housing. In a developing process, toner particles adhere to carrier particles by triboelectric charging due to friction between the particles during agitation and transport in the developer cartridge housing. The carrier particles transport toner particles to a developer transfer region and apply the toner to an image bearing member, such as a recording sheet or media. As toner is consumed in the developing process, the developer cartridge housing is replenished with new developer including carrier particles and toner particles. Over time, carrier particles become impacted and are altered due to the harsh environment in the developer cartridge housing. These impacted/altered beads are discharged as trickle from the developer cartridge housing via a trickle port formed in the housing.

FIG. 2 is an exploded perspective view of a known developing system 100 for an electrophotographic system. As shown therein, the developing system 100 is a four stage developing system generally including four developer cartridges 110 for respectively developing images with magenta (M), yellow (Y), cyan (C) and black (Bk) developer, and a trickle collection system 120. The trickle collection system 120 generally includes a trickle collection tree 122 and a trickle collection bottle assembly 124. The trickle collection tree 122 generally includes four inclined branches 126 (M, Y, C and Bk), and a plurality of vertical stems 128, 130 and 132 connecting the branches 126 to the trickle collection bottle assembly 124. Each branch 126 generally includes a trickle port 134, a trickle collection funnel 136 and a Y-connector 138. Each trickle port 134 (M, Y, C, Bk) is provided in a developer housing wall of a respective developer cartridge 110 to communicate the interior of the developer cartridge housing 152 with the exterior, to permit gravity feed of trickle output by the developer cartridge 110 via the trickle port 134 to a respective trickle collection funnel 136 of the trickle collection system. Trickle collected by each trickle collection funnel 136 in turn is gravity fed through a respective branch 126 and the vertical stems 128, 130, 132 of the trickle collection tree 122 and collected in the trickle collection bottle assembly 124.

Known trickle collection systems have a number of drawbacks. Gravity feed trickle collection systems are prone to blockage or bridging of trickle due to various factors including collection angle, humidity and material state changes. The angle of repose of developer material typically is around 38-55 degrees. Changes in external humidity or internal conditions affecting the developer can aggravate this limitation. Accordingly, gravity feed trickle collection system elements must be arranged in locations and with orientations that facilitate gravity feed, that is, generally vertically depending from developer cartridge housings.

A gravity feed collection system also requires an auger system to deposit trickle gathered by a trickle collection tree into a collection bottle. Such trickle collection systems require a user or customer service engineer to stop production of prints in order to replace the collection bottle when it is full. Such auger systems have a drawback due to leakage at auger interfaces and worn seals.

Known electrophotographic systems also have drawbacks related to size, shape and orientation requirements. For example, electrophotographic systems that use multiple developer cartridges must stack or otherwise arrange the developer cartridges and may have substantial size requirements and other limitations (e.g., height and footprint limitations). These size requirements and other limitations may impose restrictions on the location of trickle ports on the developer cartridge housing and the trickle collection system elements within the electrophotographic apparatus. Variations in mounting orientations (horizontal orientation) of developing cartridges due to individual internal mounting tolerances and external factors, such as the support surface, also may impose restrictions on the location of trickle ports and trickle collection system elements. Generally, apparatus size and shape restrictions/limitations are determined to satisfy user needs and desires.

Thus, a need exists for an improved trickle collection system and method that overcomes these drawbacks of known electrophotographic systems and trickle collection systems and methods. In particular, a need exists for an improved trickle collection system that reduces the impact of size and orientation restrictions of a developer cartridge and accommodates user needs and desires for a compact electrophotographic system.

SUMMARY

A trickle collection system of the present disclosure overcomes these drawbacks of known trickle collection systems, and provides advantages over known trickle collection systems and methods and electrophotographic systems.

In one aspect, a trickle collection system of the present disclosure includes a trickle port formed in a developer housing and communicating with the interior of the developer housing, and a trickle port housing communicating the trickle port with an external vacuum collection source. In one embodiment, the trickle port may include an aperture having a variable cross-section, for controlling an amount of flow of trickle through the port. The trickle collection system also may include an air infusion port communicating the interior of the trickle port housing with external air and providing infusion of an amount of external air into the trickle port housing sufficient to maintain adequate transport velocity and facilitate flow of trickle from the trickle port to the external vacuum collection system. An aperture of the air infusion port may be variable, such that the amount of air infusion may be varied in accordance with internal and/or external conditions. In another aspect, the trickle collection system further may include a toner emission manifold disposed below the developer housing, where the toner emission manifold includes a toner collection port that collects toner adjacent a developer transfer region of the developer housing, and where the trickle port housing communicates with the toner emission manifold at a location remote from the developer transfer region. In another aspect, the trickle collection system may include the vacuum collection system and/or the toner emission manifold.

In another aspect, an electrophotographic system of the present disclosure includes a developer housing, a vacuum collection source, and a trickle collection system including a trickle port and a trickle port housing, where the trickle port communicates the interior of the developer housing with the trickle port housing, and the trickle port housing communicates the trickle port with the vacuum collection source. In one embodiment, the electrophotographic system may include a toner emission collection manifold having a toner collection port disposed adjacent a developer transfer region of the developer housing and a lower manifold disposed below the developer housing and communicating the toner collection port with the vacuum collection source, where the trickle housing communicates the trickle port with the vacuum collection source via communication with the lower manifold. Further, the electrophotographic system may include a plurality of developer cartridge housings and a plurality of trickle collection systems each communicating the interior of a respective developer housing to the vacuum collection source.

DETAILED DESCRIPTION OF EMBODIMENTS

Various embodiments of a trickle collection system of the present disclosure and an electrophotographic system using such trickle collection system now will be described in connection with the drawings, in which like or similar elements are identified using like or similar reference numbers throughout the drawings.

Figure 1:
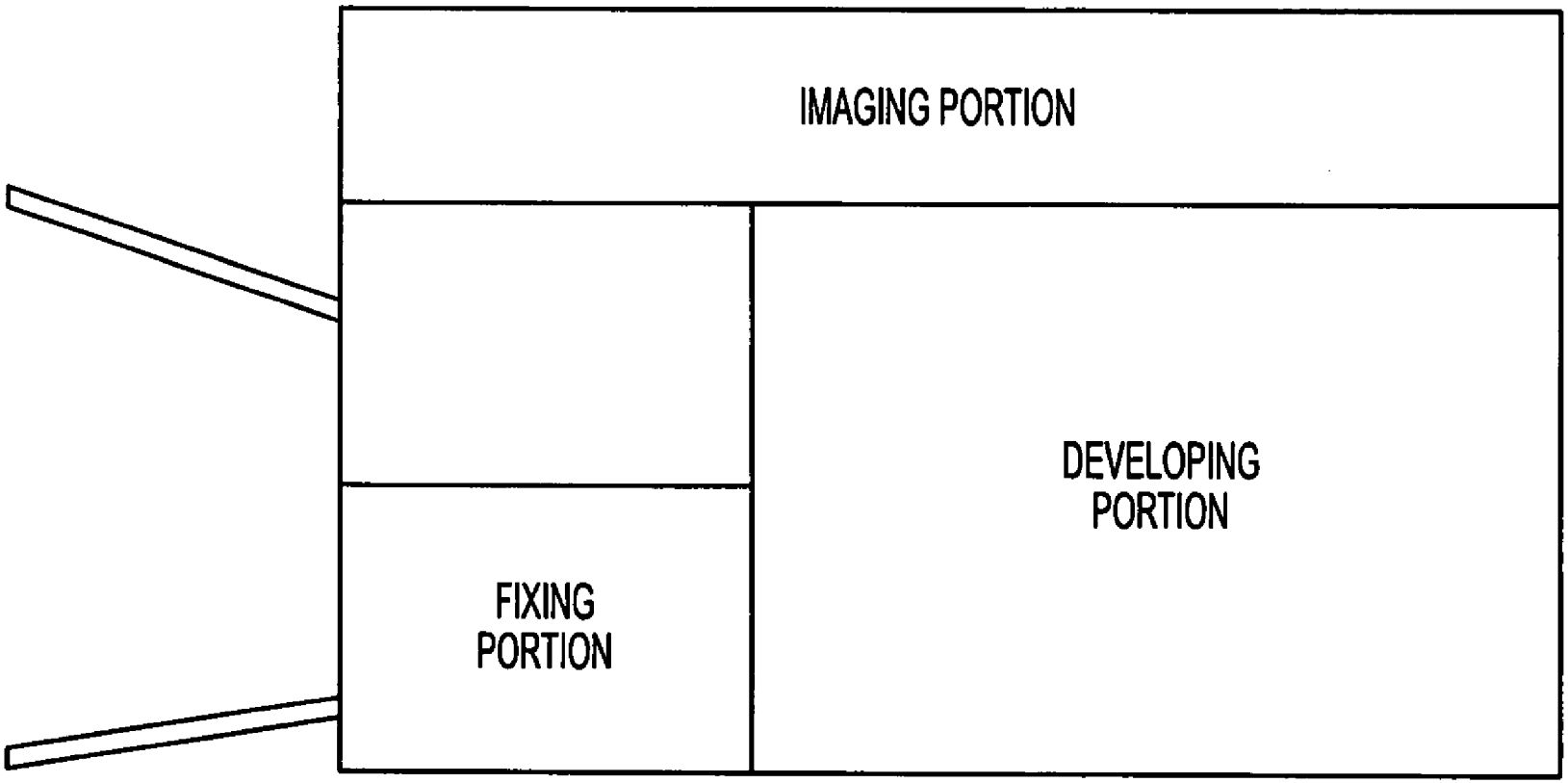
FIG. 1 schematically illustrates an electrophotographic apparatus in which a trickle collection system of the present application may be implemented.

FIG. 1 schematically illustrates an electrophotographic apparatus in which a trickle collection system and method of the present disclosure may be implemented. As described above, an electrophotographic apparatus generally includes an imaging portion for generating a latent image on an image bearing member, such as a recording sheet or media, a developing portion for applying toner to the latent image to develop the toner image on the image bearing member, and a fixing portion for fixing the developed image on the image bearing member. These structures and their elements are well known to those skilled in the art in many varied embodiments, and therefore will be described in detail below only to the extend sufficient to make and use the claimed trickle collection system and method and electrophotographic system using such trickle collection system and method.

Figure 3:
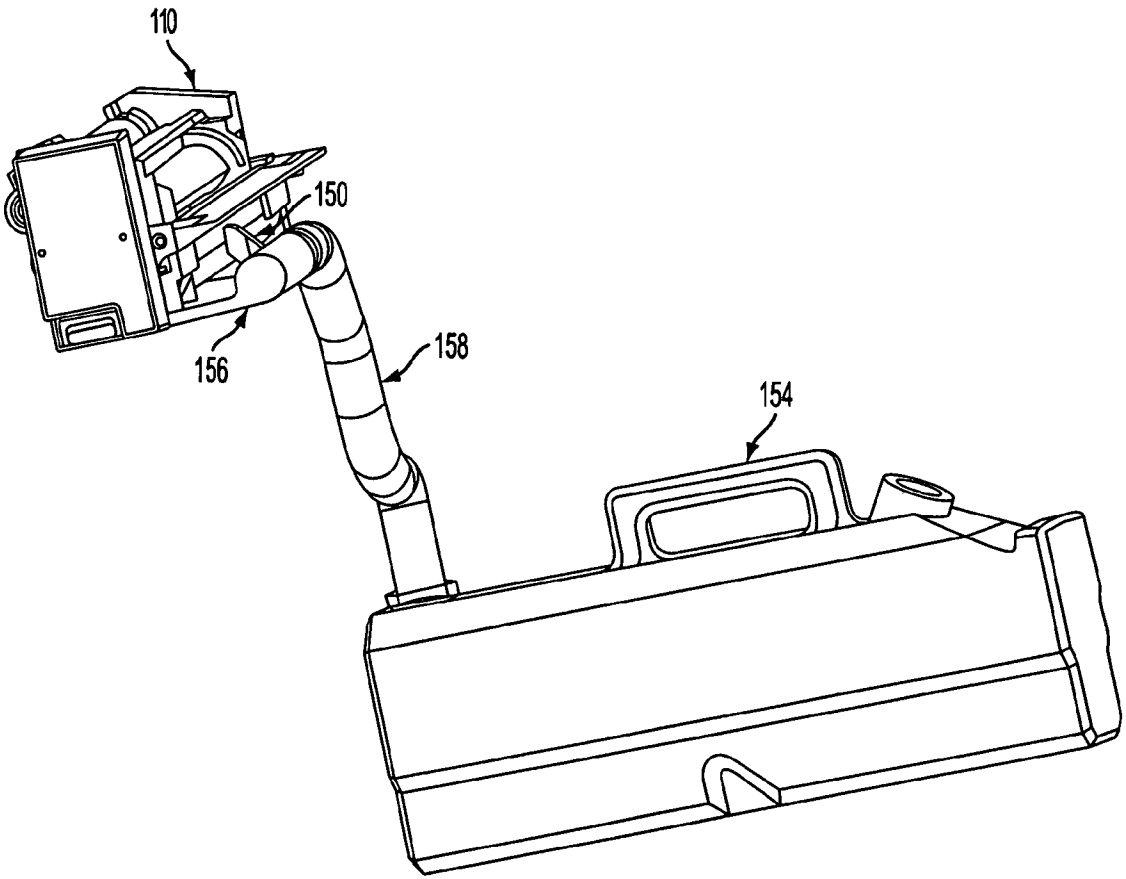
FIG. 3 is a perspective view of a trickle collection system of the present disclosure.
Figure 4:
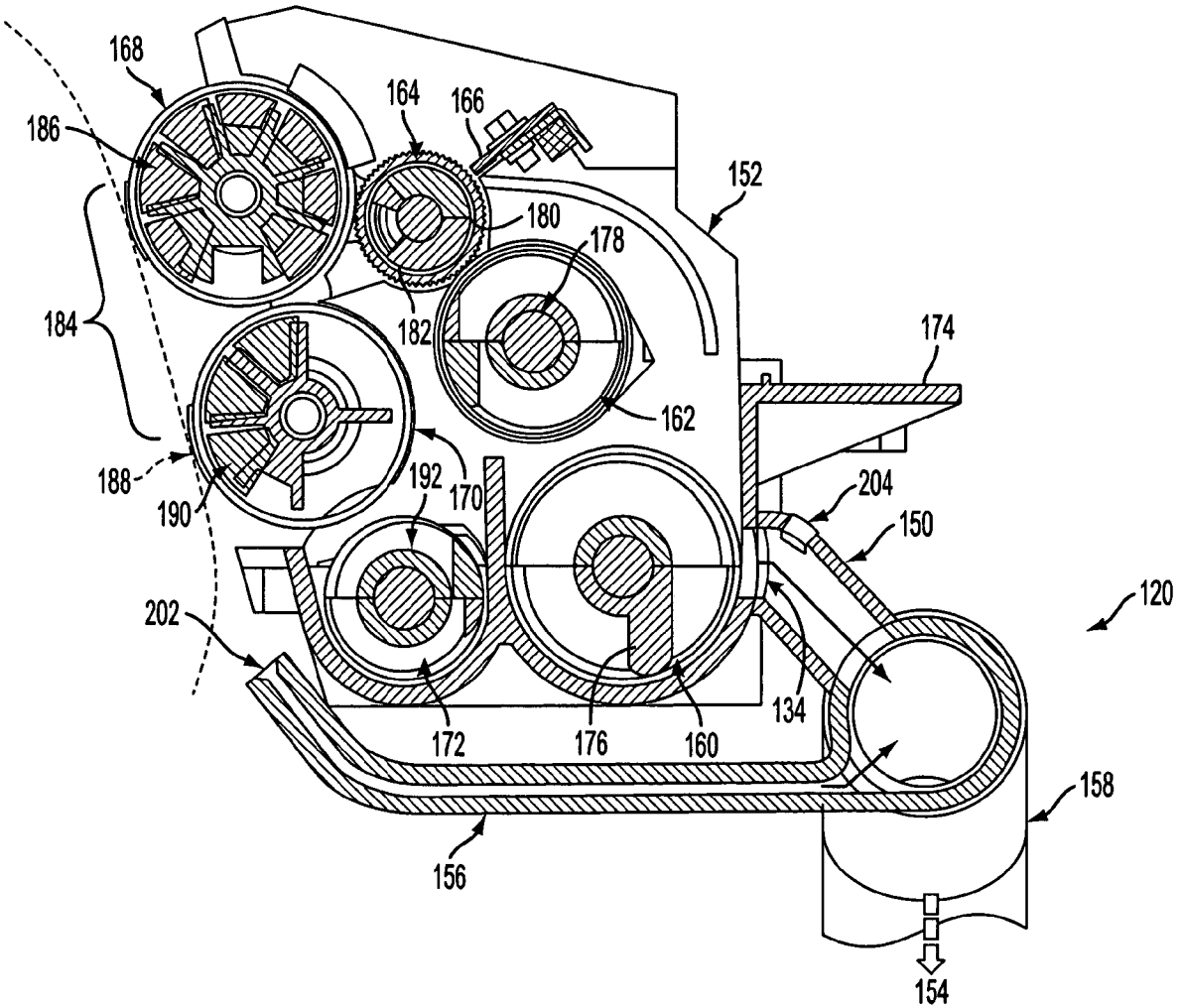
FIG. 4 is a cross-sectional view of a developer housing having a trickle collection system according to the present disclosure.

FIG. 3 is a perspective view of a trickle collection system of the present disclosure communicating with a vacuum collection source, and FIG. 4 is a cross-sectional view of a developer cartridge housing having a trickle collection system according to the present disclosure.

As shown in FIGS. 3 and 4, a trickle collection system 120 of the present disclosure generally includes a trickle port 134 and a trickle port housing 150 communicating the interior of a developer cartridge housing 152 with a vacuum collection source 154. In one embodiment, the vacuum collection source 154 may be an existing, external vacuum collection source, such as a dirt collection system of the electrophotographic apparatus, and the trickle port 134 and trickle port housing 150 may communicate the interior of the developer cartridge housing 152 with the dirt collection system (vacuum collection source) 154 via a collection manifold 156 and waste hose 158. This arrangement reduces the number of elements of the system, thereby reducing costs and facilitating maximum miniaturization. Alternatively, the vacuum collection system 154 may be a separate system dedicated to servicing the trickle collection system 120. This arrangement permits the designer to maximize the effective and efficient servicing of the trickle collection system 120. Those skilled in the art readily will appreciate alternative vacuum collection sources suitable for a trickle collection system according to the present disclosure.

A description of a developer cartridge 110 of the developing portion implementing a trickle collection system 120 of the present disclosure will now be made with reference with FIG. 4. In this regard, the elements shown and described herein are exemplary only. Those skilled in the art readily will appreciate various alternative and equivalent developer cartridges and developer cartridge elements suitable for any particular application.

As shown therein, in this embodiment the developer cartridge 110 generally includes a developer cartridge housing 152, a lower right auger 160, an upper auger 162, a transfer roller 164, a trim bar 166, an upper magnetic roller 168, a lower magnetic roller 170 and a front auger 172. The developer cartridge housing 152 includes a mounting frame 174 for locating and supporting the developer cartridge 110 within the electrophotographic apparatus, as is well known in the art.

The lower right auger 162 includes a rotating agitator 176 that transports and agitates carrier particles and toner particles of a developer so as to mix the particles and generate triboelectric charge among the particles. As discussed below in greater detail, the lower right auger 162 also may be utilized to facilitate discharge of trickle from the developer cartridge housing 152. The lower right auger 160 transports triboelectrically charged developer to a region of the upper auger 162.

The upper auger 162 includes a rotating magnetic member 178 that transports triboelectrically charged developer from a region adjacent the lower right auger 160 to the transfer roller 164. The upper auger 162 and transfer roller 164 are arranged with a predetermined gap therebetween that facilitates formation of a layer of triboelectrically charged developer on the transfer roller 164.

The transfer roller 164 includes an inner magnetic member 180 and a rotating outer member 182 that transports a layer of developer attracted to the transfer roller 164 from the upper auger 162 to the upper magnetic roller 168. The trim bar 166, also known as a knife edge, forms the layer of developer on the transfer roller 164 into a layer having a substantially uniform thickness.

The uniform layer of developer is transferred from the transfer roller 164 to the upper magnetic roller 168 for delivery to the developer transfer region 184 of the developer cartridge 110. The upper magnetic roller 168 includes a plurality of interior magnetic members 186 defining a plurality of magnetic regions used to facilitate transfer of toner particles from the carrier particles to a latent image bearing member at the developer transfer region 184. For purposes of explanation, an image transfer belt schematically is illustrated in phantom as an image bearing member 188. Those skilled in the art readily will recognize numerous alternative structural arrangements and image bearing members 188, including recording sheets and media, for receiving toner to develop a latent image at the developer transfer region 184.

The lower magnetic roller 170 includes inner magnetic members 190 that define magnetic regions for collecting/removing and transporting carrier particles and excess toner particles from the developer transfer region 184. The lower magnetic roller 170 transports recaptured carrier particles and toner particles to a region of the front auger 172. The front auger 172 includes a screw 192 for agitating the carrier particles and toner particles of the developer and transporting the developer to the lower right auger 160, where the process of agitating, mixing, triboelectrically charging and transporting of the developer is repeated.

As this developing process continues, carrier particles and toner particles are recycled many times. Over time, toner particles of the developer are consumed by image developing process at the developer transfer region 184 of the developer cartridge 110; carrier particles are reused many times and become impacted and altered (degraded or damaged) due to the harsh environment in the developer cartridge housing 152.

Accordingly, it is necessary to recharge the developer cartridge 110 with new developer. Specifically it is necessary to replenish the consumed toner particles. It also is necessary to discharge the impacted and altered carrier particles as trickle from the developer cartridge housing 152, and to recharge the developer cartridge 110 with new carrier particles. The amount of toner particles and carrier particles may vary for each application depending on various factors, including area coverage of product and environmental parameters. Typically new developer including toner particles and carrier particles (e.g., steel beads, in the ratio of approximately 9:1) is dispensed into the developer cartridge housing 152. Those skilled in the art readily will be able to determine a dispensing rate suitable for any desired application.

Trickle is discharged from the developer cartridge housing 152 through a trickle port 134 formed in the developer cartridge housing 152. Operation of the lower right auger 160 may facilitate separation of trickle from the developer and discharge of the trickle from the developer cartridge housing. Typically, trickle discharged from the developer cartridge housing 152 comprises approximately 6% toner particles and 94% carrier particles (e.g., steel beads) by volume. However, this composition can vary depending on various internal and external factors, including the composition of the carrier particles and the toner particles, the dispense rate, humidity, moisture content and the like.

In the trickle collection system of the present disclosure, the trickle port 134 communicates with a trickle port housing 150, which in turn communicates with a toner emissions collection manifold 156 and waste hose 158 to a dirt collection bottle (vacuum collection source) 154. In this manner, the trickle port 134 and trickle port housing 150 communicate the interior of the developer cartridge housing 152 with the vacuum collection source 154. Of course, the trickle port 134 and trickle port housing 150 alternatively may communicate directly with the vacuum collections source 154. Those skilled in the art readily will appreciate alternative methods and systems for communicating the interior of the developer cartridge housing 152 with the vacuum collection source 154.

Figure 2:
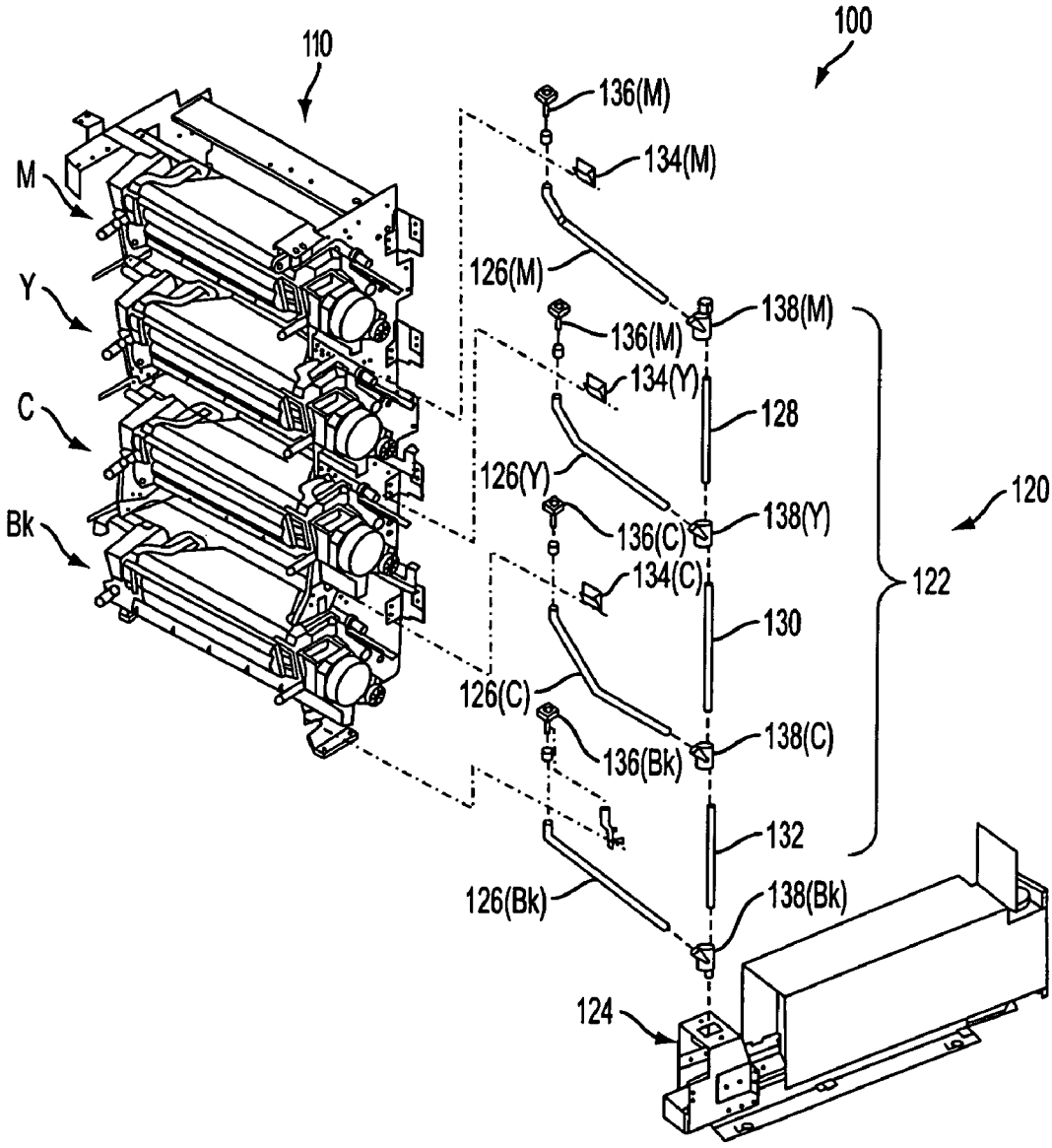
FIG. 2 is an exploded perspective view of a known four stage developing system and a gravity feed trickle collection system.

The trickle port 134 of the present disclosure may be located at any position of the developer cartridge housing 152 suitable to a desired trickle collection application because the removal of trickle is vacuum assisted. In the present embodiment, the trickle port 134 is located at a central portion of the developer cartridge housing 152 on a side opposite the developer transfer region 184 and adjacent the lower right auger 160. In this location the lower right auger 160 can facilitate separation and discharge of the trickle, as noted above. This location also reduces the sensitivity of housing sump mass to inboard (IB) or outboard (OB) tilt due to machine installation and tolerance stacks within the electrophotographic apparatus, for example, where the developing portion includes a stack of a plurality of developer cartridges 110, such as the four color developing system as shown in FIG. 2. In an alternative arrangement, two or more trickle ports with respective trickle port housings may be provided at various selected locations of the developer cartridge housing, e.g., at opposing ends of the developer cartridge housing, to reduce any effect of variations in mounting orientations (stacking tolerance) and to provide greater control of trickle rate.

As shown in FIGS. 3 and 4, a toner emissions collection manifold 156 may be located below the developer cartridge housing 152 and may include a toner emissions collection port 202 adjacent/below the developer transfer region 184. In this manner, toner that is knocked loose from the upper magnetic roller 168, the lower magnetic roller 170 or the image bearing member 188 is gravity fed and then vacuum fed to the toner emissions collection port 202 and removed by vacuum force through the toner emissions collection manifold 156 and waste hose 158 to the dirt collection bottle (vacuum collection source) 154. Moreover, in this embodiment the trickle collection system of the present disclosure may be implemented without providing an additional dedicated vacuum collection source. This reduces costs and saves space.

The size, shape and cross-section of the trickle port 134 may be selected according to the desired application. The desired size, shape and cross-section of the trickle port 134 may vary depending on a number of factors, including the location of the trickle port on the housing, the size and rate of trickle discharged, the size, shape and orientation (e.g., angle of inclination) of the trickle port housing 150, the amount of vacuum generated by the vacuum collection source 154, and the like. In the present embodiment, the trickle port 134 may include a shuttered aperture having a variable cross-section (schematically illustrated in FIG. 3) that may be set in accordance with these and other internal or external operating conditions and factors. Those skilled in the art readily will appreciate various alternative structures for achieving a variable cross-section aperture.

The size, shape, length, cross-section, orientation and composition of the trickle port housing 150 similarly may be selected according to the desired application. The size, shape, length, cross-section, orientation and composition may vary depending on a number of factors, including the size, shape, cross-section and location of the trickle port 134, the size, shape, cross-section and orientation of the toner emissions collection manifold 156 or other vacuum source connection, the composition of the developer, structural constraints imposed by the size and shape of the electrophotographic apparatus, the bead size, the trickle rate, the amount of vacuum, and the like. In a typical trickle collection system of the present disclosure, the trickle port housing may have approximately a 0.25 square inch cross-section. In one embodiment, the trickle port housing 150 may be formed of a plastic tube. Alternatively, the trickle port housing 150 may be formed of opposing U-shaped pipe portions (curved, rectangular or other geometric shape in cross-section) having mating flanges that are fixed together, e.g., by bonding, screws, bolts or the like. Further alternatively, the trickle port housing 150 may be integrally formed with the developer cartridge housing 152 and/or toner emissions collection manifold 156. Each of these alternatives provides advantages in cost, maintenance, handling, and the like, in certain circumstances. Those skilled in the art readily will appreciate numerous alternative sizes, shapes, cross-sections, orientations and compositions suitable for a desired application.

The trickle port housing 150 also may include an (optional) air injection port 204 that provides an infusion of external air into the trickle port housing 150 to increase the speed of air flow through the trickle port housing 150. This in turn may facilitate flow of trickle through the trickle port housing 150 and reduce the risk and/or incidence of blockage or bridging of the trickle. The flow of trickle through the trickle port housing 150 may vary depending on a number of factors, including the size, shape, cross-section and orientation of the trickle port housing 150, the amount of vacuum, the bead size, the trickle rate, and the like. In the present embodiment, the air injection port 204 may include a shuttered aperture having a variable cross-section (illustrated schematically in FIG. 3) that may be set in accordance with these and other internal or external operating conditions and factors. Those skilled in the art readily will appreciate various alternative structures for achieving a variable cross-section aperture. Also, in an alternative embodiment, the trickle port housing could be provided with two or more air infusion ports. Those skilled in the art readily will be able to select the appropriate number, size, shape and structure of the air infusion port(s) for achieving/maintaining a desired transport velocity and trickle flow.

The trickle collection system of the present disclosure variously achieves numerous advantages over known trickle collection systems and electrophotographic systems. In one aspect, the trickle collection system of the present disclosure provides a vacuum (negative pressure) in the interior of the developer cartridge housing. This negative pressure can help reduce the amount of undesired toner emissions from the developer transfer region of the developer cartridge housing that must be collected by the toner emissions collection port of the toner emissions collection manifold and stored in the vacuum collection source.

The trickle collection system of the present disclosure provides an advantage over known systems in that it eliminates the need for a separate trickle collection bottle, and the risk of contamination caused by removing/replacing such bottle during maintenance. It also eliminates maintenance requirements for an auger used to discharge trickle into a collection bottle. For example, the trickle port housing can have a substantially horizontal orientation (0 degree angle inclination). In a typical system, the trickle port housing may have a inclination angle in the range of 10-15 degrees; this angle facilitates flow of trickle through the trickle port housing without blockage or bridging, particularly at the entrance of the trickle port housing. Those skilled in the art readily will be able to select the appropriate angle of inclination of the trickle port housing suitable to a desired application.

The trickle collection system of the present disclosure provides an advantage over known systems in that it enables greater latitude in arranging trickle collection system elements.

The trickle collection system of the present disclosure provides an advantage over known systems in that it permits greater latitude in design and miniaturization of the trickle collection system, the developing portion and an electrophotographic system containing the same.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A trickle collection system comprising:

a trickle port formed in a developer housing and communicating with the interior of the developer housing;

a vacuum collection source that collects trickle by vacuum force; and a trickle port housing communicating the trickle port with the vacuum collection source.

2. The trickle collection system of claim 1, further comprising:

a toner emission collection manifold disposed below the developer housing and communicating with the vacuum collection source, the toner emission collection manifold including a collection port disposed adjacent a developer transfer region of the developer housing for collecting toner emissions at the developer transfer region, wherein the trickle port housing communicates with the toner emission manifold at a location remote from the developer transfer region.

3. The trickle collection system of claim 1, further comprising:

an air infusion port communicating the interior of the trickle port housing with external air and providing infusion of an amount of external air into the trickle port housing sufficient to facilitate flow of trickle from the trickle port to the vacuum collection system.

4. The trickle collection system of claim 3, wherein the air infusion port has an aperture with a variable cross-section for controlling the amount of external air infused through the air infusion port.

5. The trickle collection system of claim 1, wherein the trickle port is located at a central portion of the developer housing.

6. The trickle collection system of claim 1, wherein the vacuum collection source comprises a removable collection bottle.

7. The trickle collection system of claim 1, wherein the trickle port has an aperture with a variable cross-section.

8. A trickle collection method for a developer cartridge of an electrophotographic system, the method comprising:

providing a trickle port communicating with the interior of a developer cartridge housing; and communicating the trickle port with a vacuum collection source to collect with vacuum force trickle discharged from the interior of the developer cartridge via the trickle port.

9. The trickle collection method of claim 8, further comprising:

disposing a toner emission collection manifold below a developer housing, with a toner emissions collection port adjacent a developer transfer region of the developer cartridge, and communicating the toner emission collection manifold with the vacuum collection source; and communicating the trickle port with the toner emission collection manifold at a location remote from the developer transfer region.

10. The trickle collection method of claim 8, the communicating step further comprising:

communicating the trickle port with the vacuum collection source through a trickle port housing; and infusing external air into the trickle port housing to facilitate transport of trickle through the trickle port housing and collection of the trickle in.

11. An electrophotographic system comprising:

a developer housing;

a vacuum collection source that collects trickle with vacuum force; and a trickle collection system including a trickle port and a trickle port housing, the trickle port communicating the interior of the developer housing with the trickle port housing, and the trickle port housing communicating the trickle port with the vacuum collection source.

12. The electrophotographic system of claim 11, further comprising:

a toner emission collection manifold having a toner collection port disposed adjacent a developer transfer region of the developer housing and a lower manifold disposed below the developer housing and communicating the toner collection port with the vacuum collection source, wherein the trickle port housing communicates the trickle port with the vacuum collection source via communication with the lower manifold remote from the toner collection port.

13. The electrophotographic system of claim 11, further comprising:

a plurality of developer housings; and a plurality of trickle collection systems each communicating the interior of a respective one of the plurality of developer housings with the vacuum collection source.

14. The electrophotographic system of claim 13, wherein at least two of the plurality of developer housings are stacked one upon another.

15. The electrophotographic system of claim 13, wherein at least two of the plurality of trickle collection systems have a common connection with the vacuum collection source.

16. The electrophotographic system of claim 14, wherein the electrophotographic system is a color system including a plurality of color developer cartridge housings.

17. The electrophotographic system of claim 11, further comprising:

a collection container associated with the vacuum collection source that stores trickle collected by the trickle collection system.

18. The electrophotographic system of claim 11, wherein the trickle port housing includes an air infusion port communicating the interior of the trickle port housing with external air and providing infusion of an amount of air into the trickle port housing sufficient to facilitate flow of trickle from the trickle port to the vacuum collection source.

19. The electrophotographic system of claim 11, wherein the electrophotographic system is a xerographic system.

* * * * *